United States Patent [19]

Sado et al.

[11] 4,314,115

[45] Feb. 2, 1982

[54] KEY-BOARD SWITCHING UNIT

[75] Inventors: Ryoichi Sado, Saitama; Koichi Nei, Tokyo, both of Japan

[73] Assignee: Shin-Etsu Polymer Co., Ltd., Tokyo, Japan

[21] Appl. No.: 133,663

[22] Filed: Mar. 25, 1980

[30] Foreign Application Priority Data

Jul. 4, 1979 [JP] Japan ..... 54-46393

[51] Int. Cl.[3] ..... H01H 13/70

[52] U.S. Cl. ..... 200/5 A; 200/159 B

[58] Field of Search ..... 200/5 A, 159 B

[56] References Cited

U.S. PATENT DOCUMENTS 4,158,115 6/1979 Parkinson et al. ..... 200/5 A

*Primary Examiner*—J. V. Truhe

*Assistant Examiner*—Morris Ginsburg

*Attorney, Agent, or Firm*—Hopgood, Calimafde, Kalil, Blaustein & Judlowe

[57] ABSTRACT

The invention provides a novel key-board switching unit used, for example, in pocketable electronic calculators for producing binary-coded signals corresponding to contacting of movable contact points on the bottom surface of a keyboard covering pad and fixed contact points on the printed circuit board on which the covering pad is mounted when pushed with a finger tip or a pushing means. The printed circuit board in the inventive switching unit has a so fine and complicated circuit pattern that, in the prior art, one or more of jumping circuits crossing over a printed base pattern are indispensable resulting in much increased production costs while, in the inventive switching unit, the circuit pattern on the circuit board per se may be incomplete by the lack of such jumping circuits and, instead, the covering pad is provided with conductive connections corresponding to the lacking jumping circuits on the circuit board to form necessary jumping circuits when the covering pad is mounted on the circuit board.

1 Claim, 5 Drawing Figures

KEY-BOARD SWITCHING UNIT

BACKGROUND OF THE INVENTION

The present invention relates to a key-board switching unit or, more particularly, to a novel key-board switching unit which is very versatile in design facilitating easy manufacturing by virtue of its unique and improved structure.

Various kinds of modern electronic instruments, such as a pocketable electronic calculator, are provided with a key-board switching unit for operating the instrument, for example, in calculation with the calculator by producing binary-coded signals. Conventional key-board switching units have a structure in which a printed circuit board having a fixed contact points is covered with a key-board covering pad of an electrically insulating rubbery material provided with one or a plurality of movable contact points leaving a narrow interspace therebetween by means of spacers. The binary digital signals are obtained when the movable contact point is contacted with the corresponding fixed contact point or comes apart therefrom according to pushing or releasing of the covering pad at the appropriate position.

The above mentioned printed circuit board used in the key-board switching unit is usually prepared by providing a desired electric circuit with a metal foil bonded to an insulating board and etched to have a desired circuit pattern. According to the recent trend of miniaturization of electronic instruments, the circuit pattern on the printed circuit board is also required to be finer and finer and more and more complicated. Sometimes there arises a difficulty in forming a so fine and complicated circuit only on one side of the circuit board completed as such.

Such a difficulty is usually obviated by providing a printed circuit pattern also on the bottom surface of the circuit board in addition to the top surface of the board facing the covering pad, electric connection between two circuit patterns on the top and the bottom surfaces being obtained by wiring through one or more of penetrating holes provided in the board. Alternatively, jumping connections are provided crossing over a printed circuit pattern formed as usual on the surface of the circuit board with an insulating layer therebetween.

The above mentioned means for obviating the difficulties in forming a so fine and so complicated circuit pattern on the surface of a circuit board are never free from the disadvantages of the complicated procedure for manufacturing the printed circuit boards necessarily leading to increased production costs of the desired key-board switching units.

SUMMARY OF THE INVENTION

It is therefore an object of the present invention to provide a novel and improved key-board switching unit comprising a printed circuit board and a key-board covering pad laid thereon which is free from the above described disadvantages in the prior art key-board switching units even when the circuit pattern on the printed circuit board is very fine and complicated.

Thus, the key-board switching unit of the invention comprises (a) a printed circuit board made of an electrically insulating board provided on one surface thereof with a printed circuit pattern having a plurality of fixed contact points, said circuit pattern being incomplete by the lack of at least one jumping connection, (b) a key-board covering pad made of an electrically insulating rubbery material provided on one surface thereof with a plurality of movable contact points at positions corresponding to the fixed contact points on the printed circuit board and at least one connection circuit on the same surface as the movable contact points at a position corresponding to the lacking jumping connection on the printed circuit board, said covering pad being mounted on the printed circuit board in such a manner that each of the movable contact points faces respective one of the fixed contact points on the printed circuit board, and (c) at least one spacer means positioned between the printed circuit board and the covering pad to form a narrow interspace between the fixed contact points and the movable contact points.

DETAILED DESCRIPTION OF THE PREFERRED EMBODIMENTS

Figure 1A:
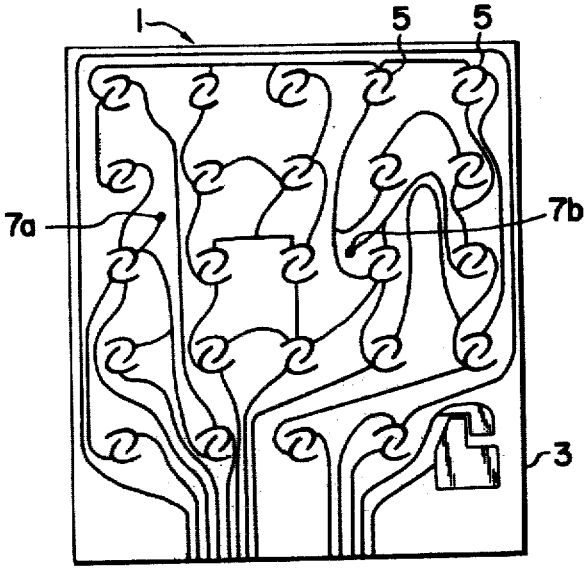
FIG. 1*a* and FIG. 1*b* are a top view of a printed circuit board lacking a jumping connection and a bottom view of a covering pad to be mounted on the circuit board, respectively.

As is self-evident from the above given definition of the inventive key-board switching unit, the troublesome means of providing one or more of jumping connections on a printed circuit board, without which the circuit pattern is not completed, can totally be omitted since the circuit necessary to form a jumping connection is provided on the covering pad and integrated with the incomplete circuit on the printed circuit board to form a complete circuit pattern.

The printed circuit board used in the inventive key-board switching unit is conventional and need not be described in detail. The printed circuit pattern formed on an electrically insulating board by the techniques of etching of metal foils or like techniques, in this case, may be, however, incomplete as such due to the lack of one or more of jumping connections, which are conventionally formed by, for example, printing with an electroconductive paint or a like material on the underlying printed circuit pattern with an insulating layer therebetween. The disposition of the fixed contact points on the printed circuit board is also according to need and not defined limitatively.

The key-board covering pad to cover the printed circuit board is typically made of a sheet material of an electrically insulating rubber or a plastic material having rubber-like resilience as is used conventionally in the prior art covering pad of similar types.

The movable contact points made, for example, of an electro-conductive rubber are adhesively bonded to the bottom surface of the covering pad at the positions corresponding to the individual fixed contact points or pairs of the contact points on the printed circuit board so that the fixed and movable contact points facing each other come to contact when the covering pad is pushed on the top surface thereof by a finger tip or other pushing means to produce an electric signal. This principle and structure of the covering pad so far are conventional and need not be explained in further detail.

The most characteristic feature of the invention is that the key-board covering pad is provided with at least one connection circuit on the same surface as the movable contact points. The connection circuit on the covering pad comes to contact with the printed circuit pattern at two points or more when the covering pad is mounted to cover the printed circuit board so as that bridging is provided between the contacted points on the printed circuit board, which points would be connected by a jumping circuit in a conventional printed circuit board.

The connection circuit provided on the covering pad is formed in a variety of known methods. For example, a pattern corresponding to the connection circuit may be formed by adhesively bonding thin strips of an electroconductive rubber either directly or by the technique of transfer bonding. Alternatively, the connection circuit is formed by coating or printing with an electroconductive ink or paint on the surface of the covering pad or filling the grooves engraved in the covering pad with such a conductive material. Further, the connection circuit is formed of a metallic material by bonding strips of a metal foil, metal nets or metal wires or by the technique of metal deposition by evaporation. It is advisable to provide a plating with a precious metal on the connection circuit when it is formed of a metallic material to ensure increased stability.

The surface of the connection circuit provided on the surface of the covering pad by the above mentioned methods may be at the same level as, protruded out of or recessed into the surface level of the covering pad. It is preferable, however, that the surface of the connection circuit is recessed into the surface of the covering pad. In other words, the connection circuit is preferably provided in the grooves engraved in the covering pad. It is also advisable that an insulating layer is provided on the connection circuit in order to avoid inadvertent short circuiting or to provide a protection of the circuit from the environmental influences.

As is described before, the connection circuit on the covering pad should be in contact with the circuit pattern on the printed circuit board at two or more points when the covering pad is mounted on the circuit board. In this respect it is desirable that each of the connection circuits on the covering pad has two or more of terminal points protruded out of the surface level of the other portion so as to increase the reliability of the electric connection between the circuit pattern and the jumping connection circuit.

It may be too much to say that the fixed contact points on the printed circuit board and the movable contact points on the covering pad mounted on the circuit board are separated from each other leaving a narrow interspace therebetween when the covering pad is not pushed on the top surface by a spacer means but come to contact with each other when the covering pad is pushed with resilience to regain the unpushed position. The spacers in the inventive key-board switching unit may be made of an insulating material just as in the conventional units. In the inventive unit, however, the terminal points provided to the jumping connection circuit coming into contact with the circuit pattern on the printed circuit board may serve simultaneously as the spacer means with which narrow interspaces are ensured between the contact points. Alternatively, it is optional that the circuit pattern on the board is provided with protruded contact point at the end of the lacking jumping circuit so as that the protruded contact points serve simultaneously as the terminal points to be contacted with the jumping circuit on the covering pad and as the spacer means.

It is further optional that the covering pad is formed to have raised dome-like protrusions at the positions corresponding to the respective movable contact points provided on the bottom surface of the covering pad and each movable contact point is bonded to the bottom cavity of the dome. In this case, no particular spacer means in a form of something like a stud is provided but the sloped riser portions of the dome-like protrusions serve as the spacer means.

The inventive key-board switching unit is now illustrated in further detail with reference to the drawing annexed.

Figure 1B:
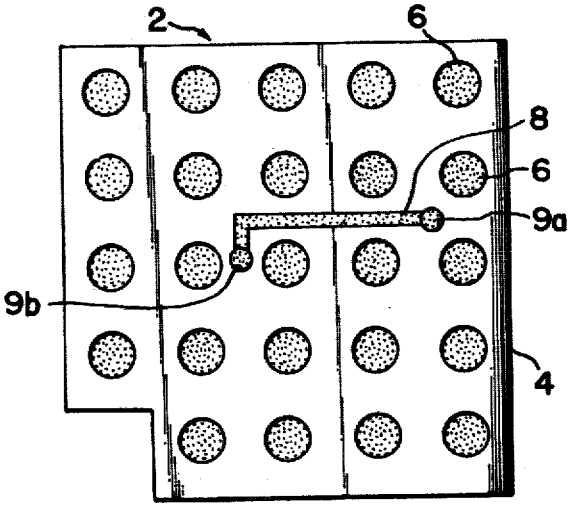

FIG. 1*a* is a top view of a printed circuit board 1 having a circuit pattern composed of 24 pairs of fixed contact points 5 and lead portions connecting them formed by etching of a metal foil bonded on to the insulating board 3. This circuit pattern is incomplete as such unless a jumping connection is provided between the free points 7*a* and 7*b*. FIG. 1*b* is a bottom view of a key-board covering pad 2 to be mounted on the circuit board 1 of FIG. 1*a* having 24 movable contact points 6 made of an electroconductive rubber and bonded to the bottom surface of the insulating rubbery covering pad 4. When this covering pad 2 is mounted on the circuit board 1 upside-down with intervening spacer means (not shown in the figure), each of the movable contact points 6 is positioned above the respective pair of the fixed contact points 5 with a narrow interspace therebetween. When the covering pad 2 is pushed at an appropriate position with a finger tip, the movable contact point 6 comes to contact with the fixed contact points 5 so that the pair of the fixed contact points 5 is electrically connected through the movable contact point 6 with elastic resilience to regain the unpushed position when the pushing force is released.

In addition to the 24 movable contact points 6, the covering pad 2 is provided with a jumping connection 8 on the same surface as the movable contact points 6. The jumping connection 8 is formed, for example and most simply, by printing with an electroconductive ink or paint but may be formed with any other suitable methods as mentioned before. When the covering pad 2 is mounted on the circuit board 1 upside-down, the jumping connection 8 bridges the free points 7*a* and 7*b* of the circuit pattern with the terminal points 9*a* and 9*b* in contact with the points 7*a* and 7*b*, respectively. These terminal points 9*a* and 9*b* are preferably in a form of a stud serving as an auxiliary spacer means.

Figure 2:
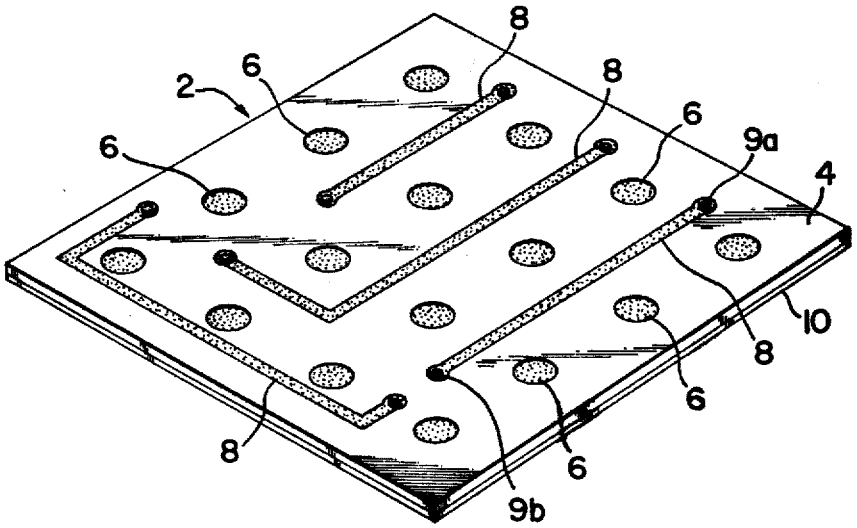
FIG. 2 is a perspective view of the bottom surface of a covering pad provided with four jumping connections.

It is of course that the number of the jumping connections 8 on the bottom surface of the covering pad 2 is not limited to one but any desired number of the jumping connections 8 can be provided. FIG. 2 shows a perspective view of the bottom surface of another covering pad according to the invention in which four jumping connections 8 are formed on the same surface along with the 16 movable contact points 6 built as embedded in the surface. As is shown in the figure, each of the jumping connections 8 has two terminal points 9*a* and 9*b* near the ends thereof which come to contact with respective terminal points 7*a* and 7*b* of the lacking jumping circuit on the printed circuit board 1 on which the covering pad 2 is mounted. These stud-like terminal points 9*a* and 9*b* also serve as the spacer means for forming a narrow interspace between the movable contact points 6 and the fixed contact points 5 as well as for preventing short-circuiting by the contacting of the jumping connections 8 with the circuit pattern on the circuit board.

Figure 3:
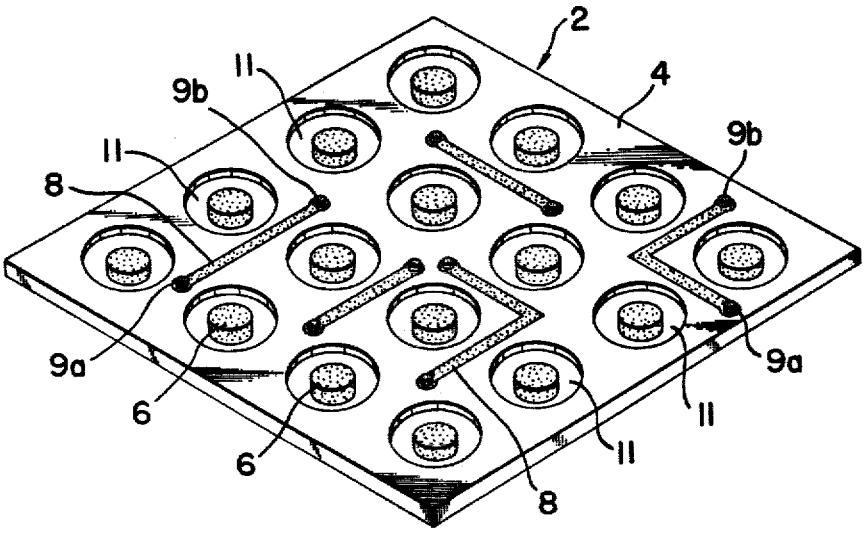
FIG. 3 is a perspective view of the bottom surface of a covering pad with dome-like protrusions for the individual movable contact points having five jumping connections.

Instead of the single sheet-like form of the covering pad 2 as is shown in FIG. 1*b* and FIG. 2, covering pad 2 may have dome-like protrusions as viewed on the top surface thereof corresponding to the individual movable contact points 6 or recesses or cavities 11 as viewed on the bottom surface and the movable contact points 6 are bonded to the bottom of the respective recesses 11 as is shown in FIG. 3. The figure shows five jumping connections 8 at positions corresponding to the lacking jumping circuits on the circuit board 1 on which the covering pad 2 is mounted. Each of the jumping connections 8 has two protruded terminal points 9*a* and 9*b* near the ends thereof which come to contact with the respective terminal points 7*a* and 7*b* of the lacking jumping circuits on the circuit board 1 when the covering pad 2 is mounted on the circuit board 1. In this particular model, the jumping connections 8 on the bottom surface of the covering pad 2 may be formed as recessed in the engraved grooves in the covering pad 2 with the terminal points 9*a* and 9*b* at their ends being at the same level of or slightly protruded above the level of the bottom surface of the covering pad 2 per se. Then, no particular spacer means are required to separate the fixed contact points 5 and the movable contact points 6 leaving a narrow interspace therebetween but, instead, the riser portions of the dome-like protrusions serve as the spacer means to form narrow interspaces between the movable contact points 6 and the fixed contact points 5. Alternatively, the same effect is obtained when the jumping connections 8 are coated with an insulating material, e.g. insulating varnish, leaving the portions corresponding to the terminal points 9*a* and 9*b* as exposed bare.

Figure 4:
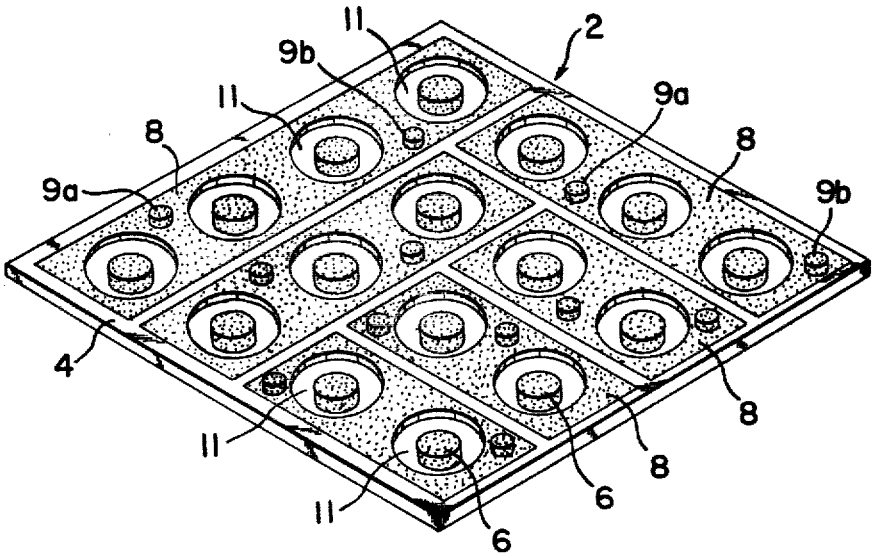
FIG. 4 is a perspective view of the bottom surface of a covering pad where each of the jumping connections is formed in a sectioned area surrounding the movable contact points.

FIG. 4 illustrates a perspective view of the bottom surface of another embodiment of the covering pad 2 used in the inventive key-board switching unit, in which the jumping connections 8 on the bottom surface of the covering pad 2 are not in the form of strips as in the model shown in FIG. 3 but are formed in several separate areas each surrounding one or several movable contact points 6 positioned as bonded to the bottom of the recesses 11 as viewed on the bottom surface corresponding to the dome-like protrusions as viewed on the top surface of the covering pad 2. As is shown in FIG. 4, each of the areas 8 for the jumping connections has twostud-like protrusions 9*a* and 9*b* serving for the terminal points in contact with the respective terminal points 7*a* and 7*b* of the lacking jumping circuits on the printed circuit board 1 on which the covering pad 2 is mounted.

As is understood from the above description, the invention key-board switching units are very advantageous in reducing the over-all costs for the preparation of the units owing to the divided formation of the printed circuit pattern per se on the circuit board and the jumping connections on the bottom surface of the covering pad simplifying the manufacturing of the printed circuit boards and facilitating easy and reliable assemblage of the switching units.

What is claimed is:

1. A key-board switching unit which comprises (a) a printed circuit board made of an electrically insulating board provided on one surface thereof with a printed circuit pattern having a plurality of fixed contacts, said circuit pattern including at least two unconnected contacts, said circuit pattern being incomplete by the lack of at least one jumping connection across said unconnected contacts, (b) a key-board covering pad made of an electrically insulating rubbery material provided on one surface thereof with a plurality of movable contacts at positions corresponding to the fixed contacts on the printed circuit board and at least one connection circuit on the same surface as the movable contacts at a position corresponding to said at least two unconnected contacts on the printed circuit board to directly connect said unconnected contacts, said covering pad being mounted on the printed circuit board in such a manner that each of the movable contacts faces respective one of the fixed contacts on the printed circuit board, and (c) at least one spacer means positioned between the printed circuit board and the covering pad to form only a narrow interspace between the fixed contacts and the movable contacts and thereby not forming an interspace between said connection circuit and said unconnected contacts.

* * * * *